US005940262A

United States Patent [19]

Archer

[11] Patent Number: 5,940,262

[45] Date of Patent: Aug. 17, 1999

[54] CONTROL CIRCUIT FOR AN ELECTROMAGNETIC DEVICE FOR CONTROLLING AN ELECTROMAGNETIC FUEL CONTROL VALVE

[75] Inventor: Michael Anthony Archer, Twickenham, United Kingdom

[73] Assignee: Lucas Industries public limited company, Solihull, United Kingdom

[21] Appl. No.: 08/932,881

[22] Filed: Sep. 18, 1997

[30] Foreign Application Priority Data

Sep. 20, 1996 [GB] United Kingdom ..... 9619786

[51] Int. Cl.[6] ..... H01H 47/04; H01H 47/22

[52] U.S. Cl. ..... 361/155; 361/154; 361/189

[58] Field of Search ..... 361/152–156, 361/159, 189, 190; 123/478, 490

[56] References Cited

U.S. PATENT DOCUMENTS

| | | | |
|---|---|---|---|
| 4,933,805 | 6/1990 | Calfus | 361/152 |
| 5,053,911 | 10/1991 | Kopec et al. | 361/154 |
| 5,412,531 | 5/1995 | Clapp, III | 361/190 |
| 5,532,526 | 7/1996 | Ricco et al. | 307/104 |
| 5,729,422 | 3/1998 | Henke . | |

FOREIGN PATENT DOCUMENTS

| | | |
|---|---|---|
| 0548925 | 6/1993 | European Pat. Off. . |
| 4413240 | 10/1995 | Germany . |
| WO8705075 | 8/1987 | WIPO . |
| WO9627198 | 9/1996 | WIPO . |

OTHER PUBLICATIONS

English Language Translation of International Application WO 96/27198, 10 pages.

European Search Report, EP 97/30 7314, 3 pages.

*Primary Examiner*—Jeffrey Gaffin
*Assistant Examiner*—Kim Huynh
*Attorney, Agent, or Firm*—Trexler, Bushnell, Giangiorgi & Blackstone, Ltd.

[57] ABSTRACT

A control circuit for an electromagnetically operable fuel control valve of a vehicle engine includes a tank capacitor which upon closure of first and second controllable switches supplies current to the winding of the valve to achieve a high rate of rise of current in the winding and rapid operation of the valve. Following operation of the valve it is maintained in its operated state by current chopping action, the current rise being achieved by drawing current from a low voltage source through a third controllable switch. The current fall is at a high rate and the resultant high voltage induced in the winding is utilized to recharge the tank capacitor.

3 Claims, 2 Drawing Sheets

CONTROL CIRCUIT FOR AN ELECTROMAGNETIC DEVICE FOR CONTROLLING AN ELECTROMAGNETIC FUEL CONTROL VALVE

BACKGROUND OF THE INVENTION

This invention relates to a control circuit for an electromagnetic device more particularly but not exclusively, an electromagnetically operable fuel control valve forming part of the fuel system of a vehicle internal combustion engine, the control circuit comprising first and second terminals connected to the positive and negative terminals of a source of DC supply, a first controllable switch connected in series between one end of a winding forming part of the device and the first terminal, a second controllable switch connected in series between the other end of the winding and said second terminal, a first diode connected between said one end of the winding and said second terminal, a second diode connected between said other end of the winding and the first terminal, and means for controlling the conduction of said switches whereby when it is required to actuate the device the current in the winding is allowed to rise to a high value and is then allowed to fall to a lower value after which it is maintained for a period at a mean level by chopping action, until it is turned off to de-actuate the device.

In a known arrangement the voltage of the source of DC supply is approximately 90 volts and this is derived using a DC/DC boost converter from the 12 volt supply of the vehicle driven by the engine. The use of the higher voltage supply has a number of advantages as compared with a 12 volt supply but a disadvantage is the need to provide the converter which includes a transformer, switches, rectifiers and a control circuit. In the operation of the known circuit both switches are closed to achieve a rapid rise in the current flow and then one of the switches is opened followed by the other, this achieving when the one switch is opened current recirculation in one of the diodes and therefore a slow rate of current decay and when both switches are open, a more rapid rate of current decay with energy being fed back to the supply. At the predetermined low value of current flow both switches are closed until the current increases to slightly above the mean hold value and then the one switch is opened to allow slow current decay until the current falls slightly below the mean hold value, the one switch then being turned on and off to provide the chopping action. Finally both switches are opened to allow a rapid fall of the current to zero when it is required to de-actuate the device.

With the known circuit energy recovery can take place only when both switches are opened and the current is decaying rapidly. During the period of current chopping, energy is drawn from the source of supply but is dissipated as heat in the winding resistance and in said one diode and the second switch.

SUMMARY OF THE INVENTION

The object of the present invention is to provide such a circuit of the kind specified in a simple and convenient form.

According to the invention said source of supply comprises a tank capacitor and the circuit further includes a third controllable switch through which said one end of the winding can be connected to the positive terminal of a low voltage source of supply, the operation of said third switch being controlled by said means whereby during at least the initial portion of the period of chopping, said first controllable switch is open and current is supplied to the solenoid winding through said third controllable switch to effect a gradual increase in the current flow in the solenoid winding, said second controllable switch then being opened to allow a rapid reduction in the current flowing in the solenoid winding and a transfer of energy to said tank capacitor, said first controllable switch and said second controllable switch being closed to achieve a high rate of current rise in the winding to actuate the device.

BRIEF DESCRIPTION OF THE DRAWINGS

An example of a control circuit in accordance with the invention will now be described with reference to the accompanying drawings in which.

DESCRIPTION

Figure 1:
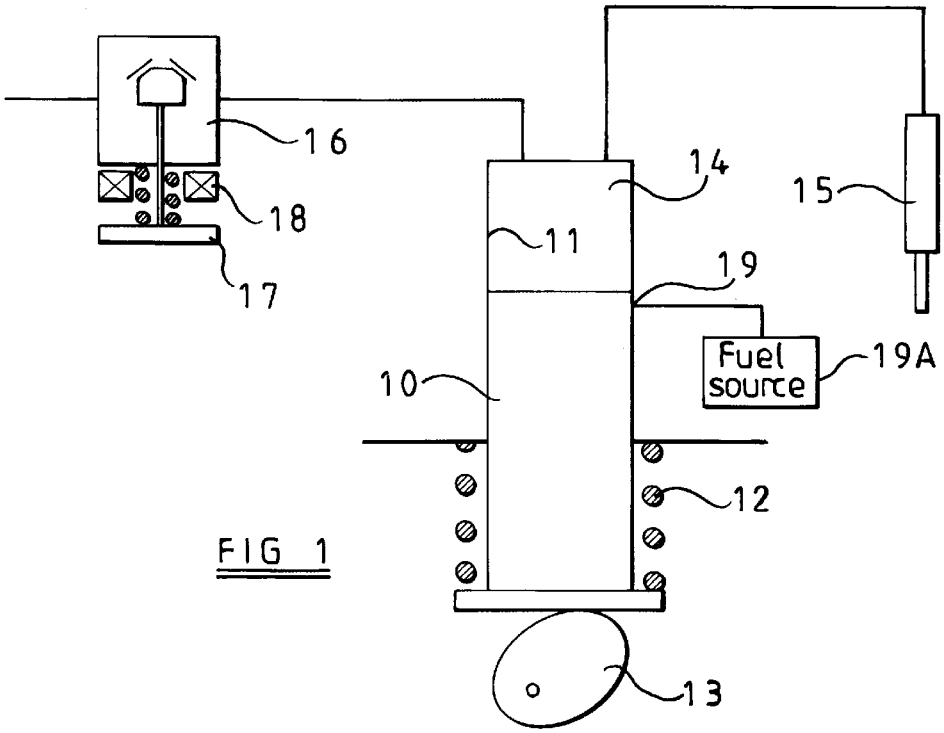
FIG. 1 illustrates in diagrammatic form, a fuel system for providing fuel to a single cylinder of a multi cylinder compression ignition engine.

Referring to FIG. 1 of the drawings the fuel system includes a fuel pump formed by a plunger 10 slidably mounted within a bore 11. The plunger is biased outwardly of the bore by means of a spring 12 and is movable inwardly against the action of the spring, by an engine driven cam 13. The bore and plunger define a pumping chamber 14 having an outlet connected to a fuel injection nozzle 15. In addition the pumping chamber is connected to a drain through a spill valve 16 which has a valve member spring biased to the open position and movable to the closed position by a magnetic field acting upon an armature 17. The magnetic field is generated when a winding 18 is supplied with electric current. When with the plunger being moved inwardly by the cam 13, the spill valve is closed, fuel will be supplied to the associated engine through the injection nozzle 15. If the spill valve is opened the fuel displaced by the plunger flows to the drain and the supply of fuel to the engine ceases. The pumping chamber may be filled with fuel through the spill valve or as is shown, through a port 19 formed in the wall of the bore 11, when the port is uncovered by the plunger during its outward movement. The port 19 communicates with a source 19A of fuel under pressure.

Figure 2:
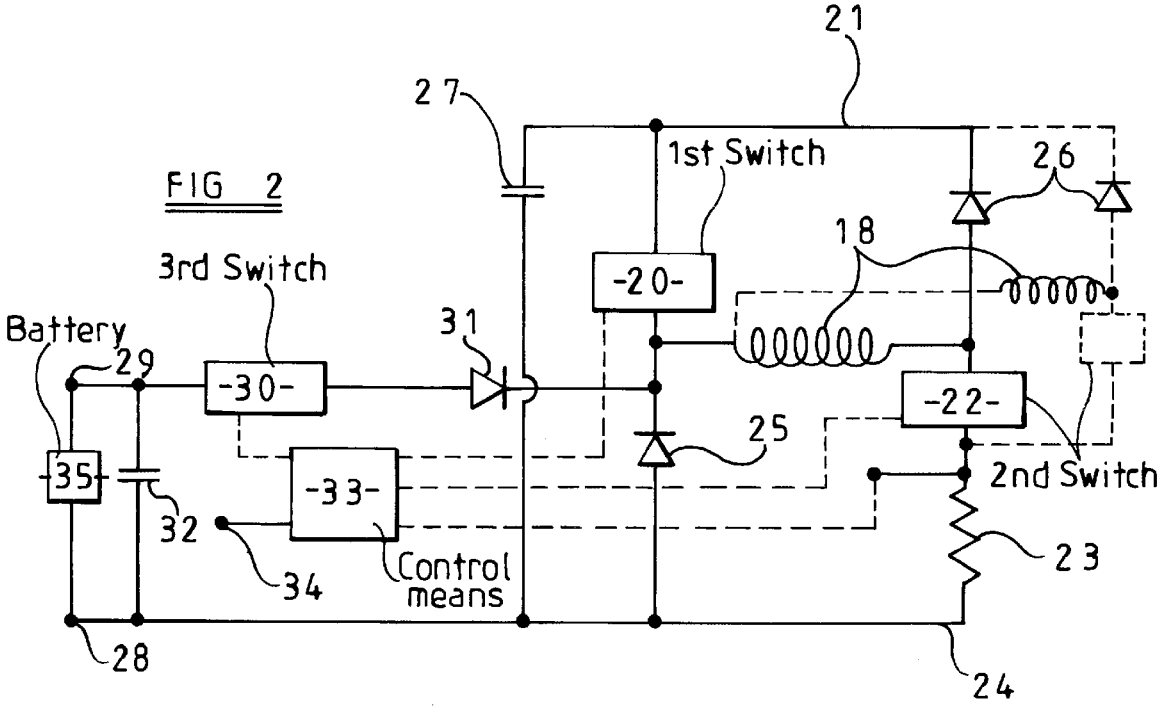
FIG. 2 shows a circuit diagram of the control circuit.

Referring now to FIG. 2, the control circuit comprises a first controllable switch 20 which is connected in series between one end of the winding 18 and a positive supply line 21. The opposite end of the winding 18 is connected through a second controllable switch 22 to one end of a current sensing resistor 23 the opposite end of which is connected to a negative supply line 24. The control circuit further includes a first diode 25 having its anode connected to the supply line 24 and its cathode to said one end of the winding 18. A second diode 26 is provided and has its anode connected to said other end of the winding 18 and its cathode connected to the supply line 21. A tank capacitor 27 is connected between the supply lines 21 and 24.

The line 24 is connected to a negative supply terminal 28 which in use is connected to the negative terminal of the vehicle battery 35. The positive terminal of the vehicle battery is connected to a positive supply terminal 29 and this is connected by way of a third controllable switch 30 to the anode of a further diode 31 having is cathode connected to said one end of the winding 16. An interference limiting capacitor 32 is connected across the terminals 28 and 29 and the operation of the controllable switches 20, 22 and 30 is determined by a control means 33 which has an input 34 from an engine control system, and a further input from a point intermediate the switch 22 and the resistor 23, the voltage at said further input being representative of the current flowing in the switch 22.

Figure 3:
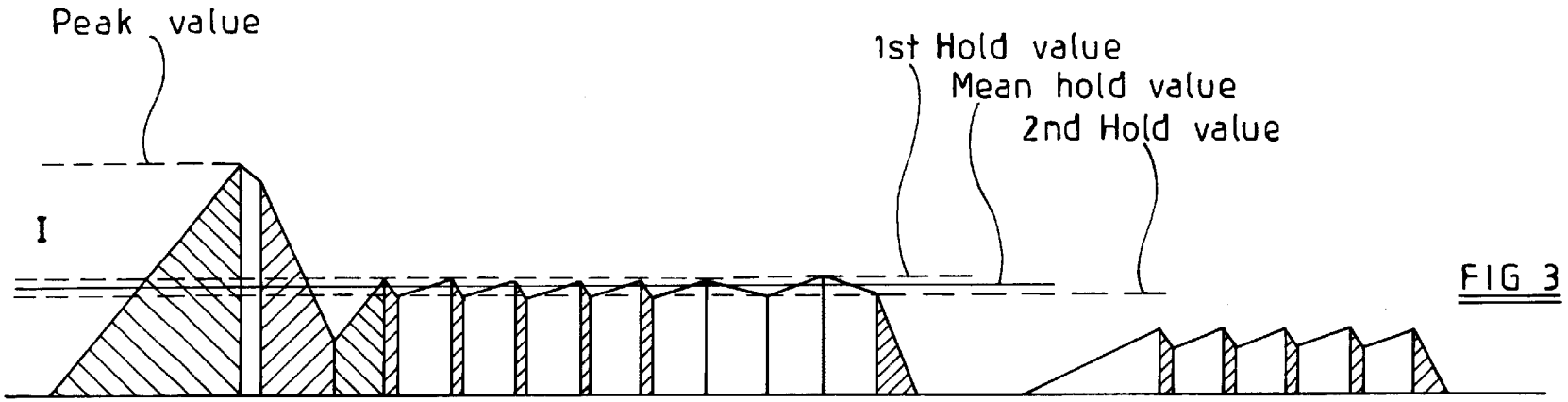
FIG. 3 shows the current flow in the winding of an actuator forming part of the fuel system.
Figure 4:
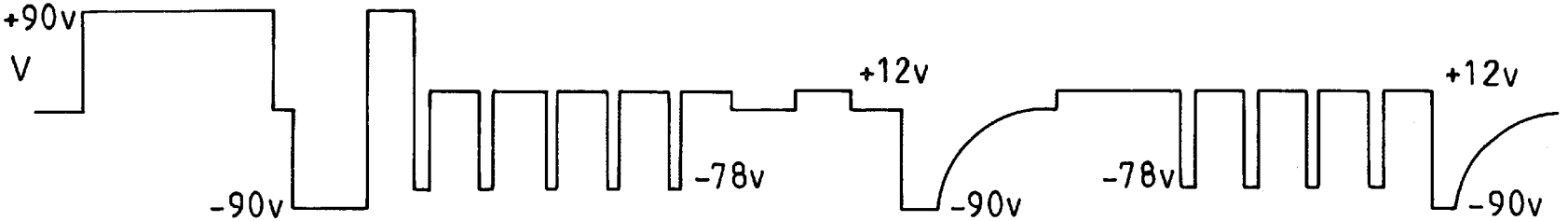
FIG. 4 shows the voltage across the winding during operation of the circuit.

Considering now the mode of operation of the circuit shown in FIG. 2, FIG. 3 shows the current waveform in the winding 18 and presupposes that the tank capacitor 27 has been charged to its working voltage of 90 volts. FIG. 4 shows the voltage across the winding 18 during operation of the circuit. It will be observed that the current initially rises at a high rate and during this period switches 20 and 22 are closed and switch 30 is open. The tank capacitor acts as a high voltage source of supply to provide the high rate of current rise up to a predetermined peak value. When the peak value of current is reached switch 20 is opened and the current decays at a slow rate with the diode 25 acting as a flywheel diode. Switch 22 is then opened and the rate of current decay increases. The high rate of current decay induces a high voltage between the ends of the winding and by way of the diodes 25 and 26, energy is fed back into the tank capacitor 27.

The current flowing in the winding is allowed to fall to a low value and then switches 20 and 22 are again closed so that the current flow in the winding increases at a high rate. When the flow of current reaches a first hold value which is slightly above a mean holding current the switches 20 and 22 are again opened to allow a rapid rate of current decay until the current falls to a second hold value which is slightly below the mean hold value. Again energy is fed back to the tank capacitor 27. When the first hold value of current is reached, switch 30 is closed and then when the second hold value is reached switch 22 is closed. This connects the winding 18 through the diode 31 and the sensing resistor 23, across the low voltage supply terminals 28 and 29 and the current in the winding increases at a relatively low rate with energy being drawn from the low voltage supply. When the first hold value of current is reached switch 22 is opened and the current decay is at the high rate with energy being returned to the tank capacitor. The current chopping action is repeated for so long as it is required to maintain the spill valve closed. It is pointed out that the movement of the armature 17 and the valve member of the spill valve, will start to take place as the current in the winding reaches its initial peak value and may be completed just prior to establishing the chopping action. In order to open the spill valve the switches 22 and 30 are opened and the current falls rapidly to zero and again some energy is returned to the tank capacitor.

The voltage across the tank capacitor 27 is monitored and if during the period of chopping the energy returned to the capacitor is such that the voltage reaches the desired value, the chopping action is modified by substituting the slow current decay for the rapid current decay. This is achieved by switching off the third switch 30 when the first hold value of current is reached but maintaining the second switch 22 closed. When the second hold value of current is reached the third switch 30 is re-closed and this process is repeated for so long as it is required to maintain the spill valve closed.

It is more likely that during the required closed period of the spill valve there will be insufficient time to replace the energy taken from the tank capacitor 27 during the initial portion of the valve closure process. This is particularly the case at low fuel supply levels and if a modified valve closing sequence is utilised in which the initial rapid rate of decay of current is replaced by a slow rate of decay to the start of the chopping sequence. In this case it is possible to use the winding 18 as an inductor during the period the spill valve is open. This is demonstrated in the right hand portion of FIG. 3 and it will be observed that the mean value of the current flowing in the winding is slightly lower than the mean holding current when the valve is closed. This is to ensure that there is no possibility of imparting movement to the armature 17 and the valve member of the spill valve thereby to prevent wear and maintain the operating life of the valve and device. The sequence of operation of the switches 20, 22 and 30 is as described above in relation to the initial portion of the current chopping period.

The circuit as shown in FIG. 2 may be used to power the operation of a number of spill valves 16. In this case all that is necessary is that the additional winding or windings should each have a respective second switch 22 and a respective diode 26. An additional winding, switch and diode are shown in dotted outline in FIG. 2. With such an arrangement it is possible to utilise the additional winding or windings together during the re-charging process when none of the associated spill valves are closed. In this case the windings are connected in parallel when the second switches are closed, and this allows a greater charging current.

It will be appreciated that with some forms of engine for example a Vee engine, it may be necessary to divide the spill valves into two groups and provide separate control circuits for each group.

I claim:

1. A control circuit for an electromagnetic device more particularly but not exclusively, an electromagnetically operable fuel control valve forming part of the fuel system of a vehicle internal combustion engine, the control circuit comprising first and second terminals connected to the positive and negative terminals of a source of DC supply, a first controllable switch connected in series between one end of a winding forming part of the device and the first terminal, a second controllable switch connected in series between the other end of the winding and said second terminal, a first diode connected between said one end of the winding and said second terminal, a second diode connected between said other end of the winding and the first terminal, means for controlling the conduction of said switches whereby when it is required to actuate the device, the current in the winding is allowed to rise to a high value and is then allowed to fall to a lower value after which it is maintained for a period at a mean level by chopping action until it is required to de-actuate the device, wherein said source of DC supply comprises a tank capacitor, the circuit further including a third controllable switch through which said one end of the winding can be connected to a low voltage source of supply, the operation of said third switch being controlled by said means for controlling the conduction of said switches whereby during at least the initial portion of the period of chopping, said first controllable switch is open and current is supplied to the winding from the low voltage supply through said third controllable switch to effect a gradual increase in the current flow in the winding, said second controllable switch being opened when the current flow rises slightly above said mean value, to allow a rapid reduction in the current flowing in the winding and a transfer of energy to the tank capacitor, said second controllable switch being reclosed when the current flow falls slightly below the mean value, said first and second controllable switches being closed to achieve a high rate of current rise in the winding to actuate the device, the current being drawn from the tank capacitor.

2. A control circuit according to claim 1, wherein when the voltage at the terminals of the tank capacitor achieves a predetermined value during the period of chopping, the switching mode of the controllable switches is altered to provide a slow rate of current decay in the winding.

3. A control circuit according to claim 1, wherein in the intervals between actuations of the device the third controllable switch is closed, the first controllable switch opened and the second controllable switch is operated to provide by chopping action, a reduced mean level of current flow in the winding, said reduced mean level of current flow being insufficient to actuate the device.

* * * * *